US007041037B2

(12) United States Patent
Huang

(10) Patent No.: US 7,041,037 B2
(45) Date of Patent: May 9, 2006

(54) STEPPING EXERCISER HAVING SWINGABLE FOOT SUPPORT

(76) Inventor: Sherry Huang, 7771 Goldstream Dr. Richmond, Vancouver, BC (CA) V7A 1S5

( * ) Notice: Subject to any disclaimer, the term of this patent is extended or adjusted under 35 U.S.C. 154(b) by 350 days.

(21) Appl. No.: 10/653,409

(22) Filed: Sep. 2, 2003

(65) Prior Publication Data

US 2005/0049116 A1 Mar. 3, 2005

(51) Int. Cl.
*A63B 22/04* (2006.01)

(52) U.S. Cl. ..... 482/53

(58) Field of Classification Search ..... 482/51–53, 482/70, 79–80
See application file for complete search history.

(56) References Cited

U.S. PATENT DOCUMENTS 5,545,111 A * 8/1996 Wang et al. ..... 482/53
5,628,709 A * 5/1997 Chen ..... 482/53
5,645,512 A 7/1997 Yu ..... 482/53
5,669,856 A 9/1997 Liu ..... 482/51
6,102,833 A 8/2000 Chen ..... 482/53
6,224,515 B1 * 5/2001 Chen ..... 482/53
6,315,697 B1 * 11/2001 Chen ..... 482/53
6,582,344 B1 6/2003 Tang ..... 482/53
6,712,739 B1 * 3/2004 Chen ..... 482/53
6,830,539 B1 * 12/2004 Chuang ..... 482/53

* cited by examiner

*Primary Examiner*—Stephen R. Crow
(74) *Attorney, Agent, or Firm*—Charles E. Baxley

(57) ABSTRACT

A stepping exerciser includes a casing having one end rotatably attached to a base with a shaft, two foot pedals having front portions rotatably attached to the other end of the casing and rotatable up and down relative to the casing. A pin is engaged in the middle portion of the casing to force the casing to rotate and swing relative to the base. For example, a follower is rotatably supported on the base and the pin is extended from the follower and engaged in the middle portion of the casing to swing the casing when the follower is rotated relative to the base. The follower and the pin are adjustable relative to the casing.

13 Claims, 8 Drawing Sheets

STEPPING EXERCISER HAVING SWINGABLE FOOT SUPPORT

BACKGROUND OF THE INVENTION

1. Field of the Invention

The present invention relates to a stepping exerciser, and more particularly to a stepping exerciser having a swing able foot support or having rotatable foot pedals.

2. Description of the Prior Art

Various typical stepping exercisers have been developed and comprise a foot support or a pair of foot pedals rotatably supported on a base and swing able relative to the base, for allowing the users to swing their bodies in addition to the stepping exercises.

For example, U.S. Pat. No. 5,645,512 to Yu, and U.S. Pat. No. 6,582,344 B2 to Tang disclose two of the typical stepping exercisers including a pair of foot pedals rotatably supported on a base and coupled together with three gears or worms, for allowing the foot pedals to swing relative to the base, and for allowing the users to swing their bodies in addition to the stepping exercises.

However, the gears or worms are engaged or attached to the front end of the foot pedals and the base where the foot pedals suffer the greatest forces, such that the teeth of the gears or worms may be damaged easily after use.

U.S. Pat. No. 5,669,856 to Liu disclose another typical stepping exerciser including a pair of foot pedals rotatably supported on a base and coupled together with a sprocket-and-chain coupling mechanism, for allowing the foot pedals to be coupled together. However, the foot pedals may not be caused or used to swing their bodies in addition to the stepping exercises. In addition, the sprocket-and-chain coupling mechanism includes a complicated configuration and having a number of members or elements that may not be easily assembled together by the workers.

U.S. Pat. No. 6,102,833 to Chen discloses a further typical stepping exerciser including a pair of foot pedals rotatably supported on a base. Each of the foot pedals includes a downwardly extended guide pillar to engage with two arcuate protrusions provided on the base, and to guide or to force the foot pedals to be rotated relative to the base, and thus to allow the users to swing their bodies in addition to the stepping exercises.

However, the guide pillars are required to directly engage with and force against the arcuate protrusions of the base with a frictional engagement, such that both the guide pillars and the arcuate protrusions of the base may be easily damaged after use due to the rub or scratch between the guide pillars and the arcuate protrusions of the base.

In addition, the guide pillars are extended from the front end of the foot pedals where the foot pedals suffer the greatest forces, such that the guide pillars may also be damaged easily after use.

The present invention has arisen to mitigate and/or obviate the afore-described disadvantages of the conventional stepping exercisers.

SUMMARY OF THE INVENTION

The primary objective of the present invention is to provide a stepping exerciser including a swingable foot support or including swingable foot pedals for allowing the users to swing their bodies in addition to the stepping exercises.

In accordance with one aspect of the invention, there is provided a stepping exerciser comprising a base, a casing including a first end rotatably attached to the base with a shaft, and including a second end and a middle portion, a pair of foot pedals having front portions rotatably attached to the second end of the casing, to allow the pair of foot pedals to be rotated upwardly and downwardly relative to the casing respectively, and an actuating device for actuating the middle portion of the casing to force the casing to rotate and swing relative to the base about the shaft.

The actuating device includes a pin engaged in the middle portion of the casing to force the casing to rotate and swing relative to the base, and includes a follower rotatably supported on the base and having the pin extended therefrom and engaged in the middle portion of the casing to swing the casing when the follower is rotated relative to the base. The follower includes an axle extended therefrom and rotatably secured to the base, to rotatably secure the follower to the base. The base includes an oblong hole formed therein to slidably receive the axle of the follower.

The actuating device includes a pair of links coupled between the follower and the pair of foot pedals to allow the foot pedals to rotate the follower relative to the base. Each of the foot pedals includes an actuator extended therefrom and coupled to the links respectively, to couple the foot pedals to the follower. The follower includes a pair of pegs extended therefrom and coupled to the links respectively, to couple the links to the follower.

The middle portion of the casing includes a channel formed therein to slidably receive the pin, and to allow the pin to be adjusted relative to the casing.

An adjusting device may further be provided for adjusting the pin relative to the casing, and includes a frame slidably received in the casing and coupled to the pin, to adjust the pin relative to the casing when the frame is moved relative to the casing.

The frame includes a first end coupled to the pin and a second end extended out of the casing, and an adjusting knob threaded through the second end of the frame and engaged with the shaft to move and adjust the frame relative to the casing when the adjusting knob is rotated relative to the frame and the casing. The first end of the frame includes a barrel attached thereto and rotatably engaged onto the pin. The first end of the frame includes a stud attached thereto and secured to the barrel.

A resistive device may further be provided for applying resistive forces against the foot pedals.

Further objectives and advantages of the present invention will become apparent from a careful reading of the detailed description provided herein below, with appropriate reference to the accompanying drawings.

DETAILED DESCRIPTION OF THE PREFERRED EMBODIMENT

Figure 1:
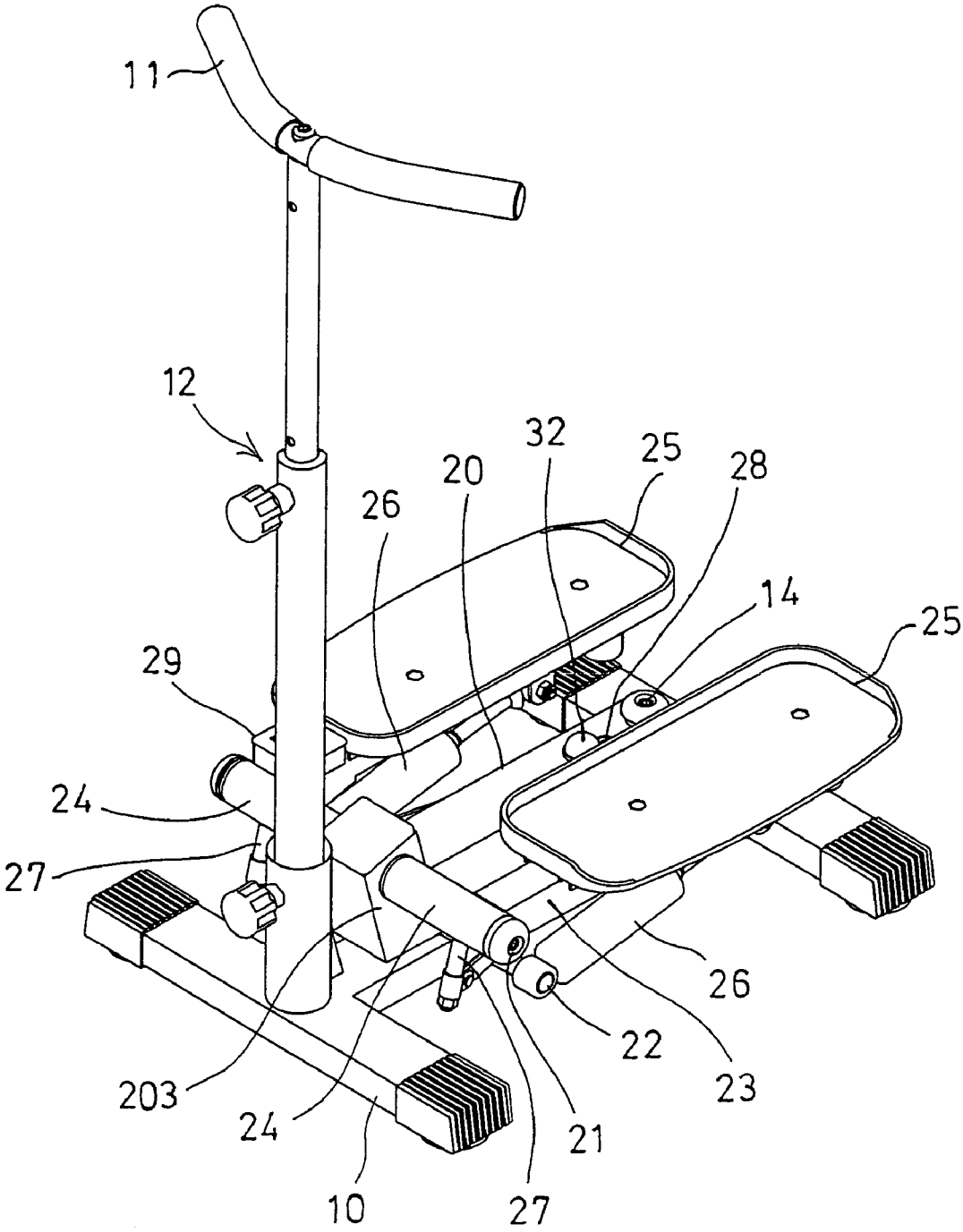
FIG. 1 is a perspective view of a stepping exerciser in accordance with the present invention.
Figure 2:
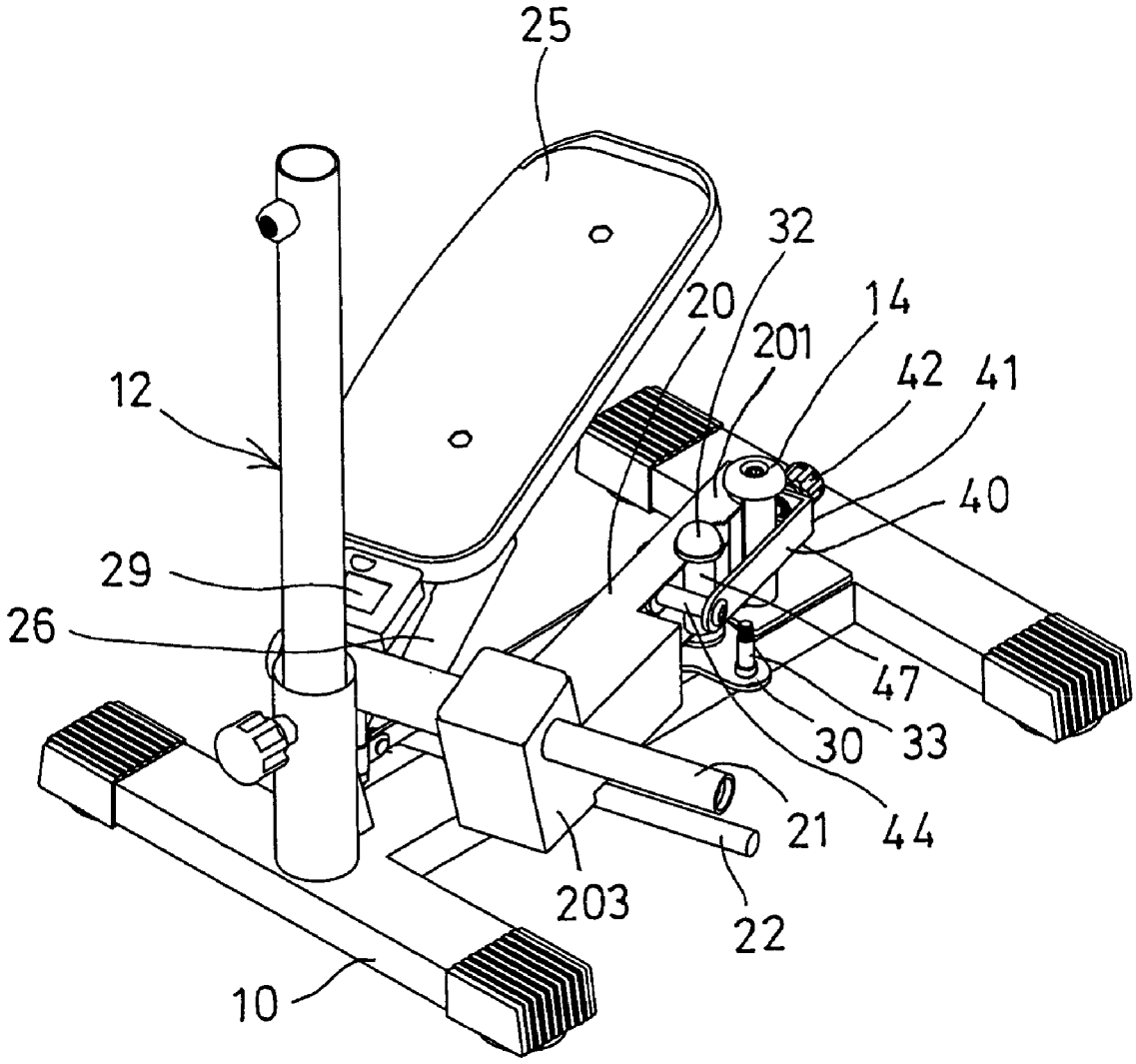
FIGS. 2, 3 are partial perspective views of the stepping exerciser.
Figure 3:
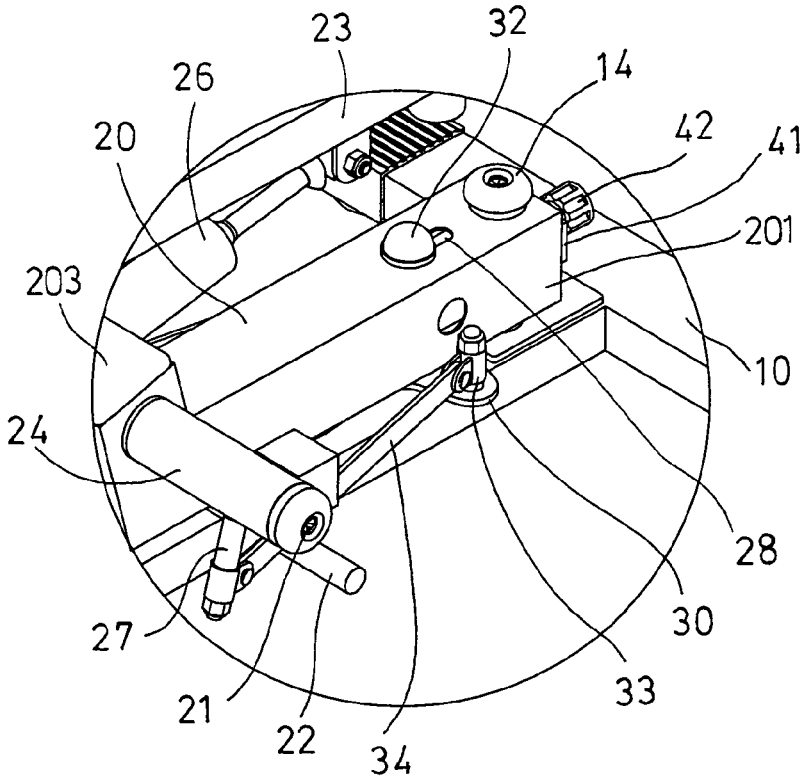
Figure 5:
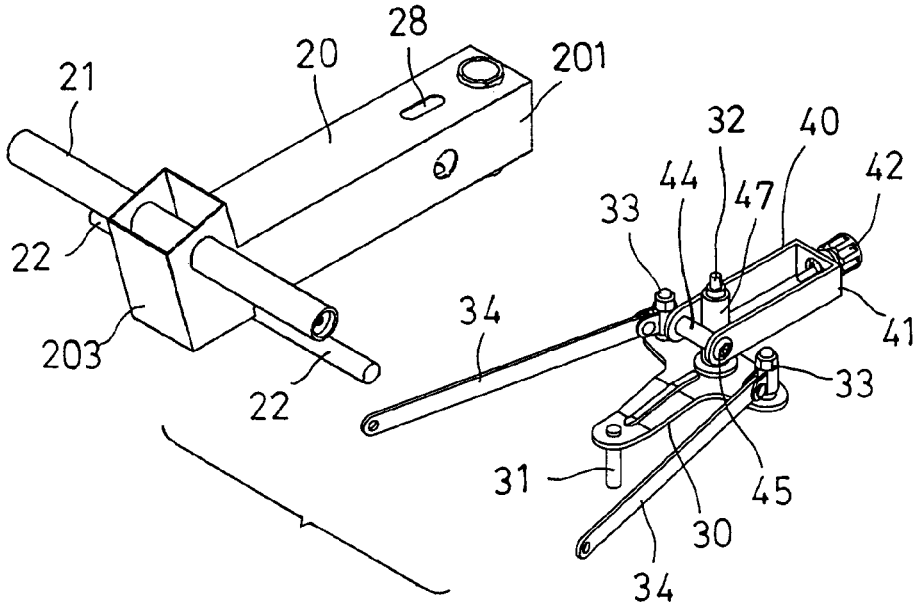
FIGS. 4, 5 are partial exploded views of the stepping exerciser.
Figure 4:
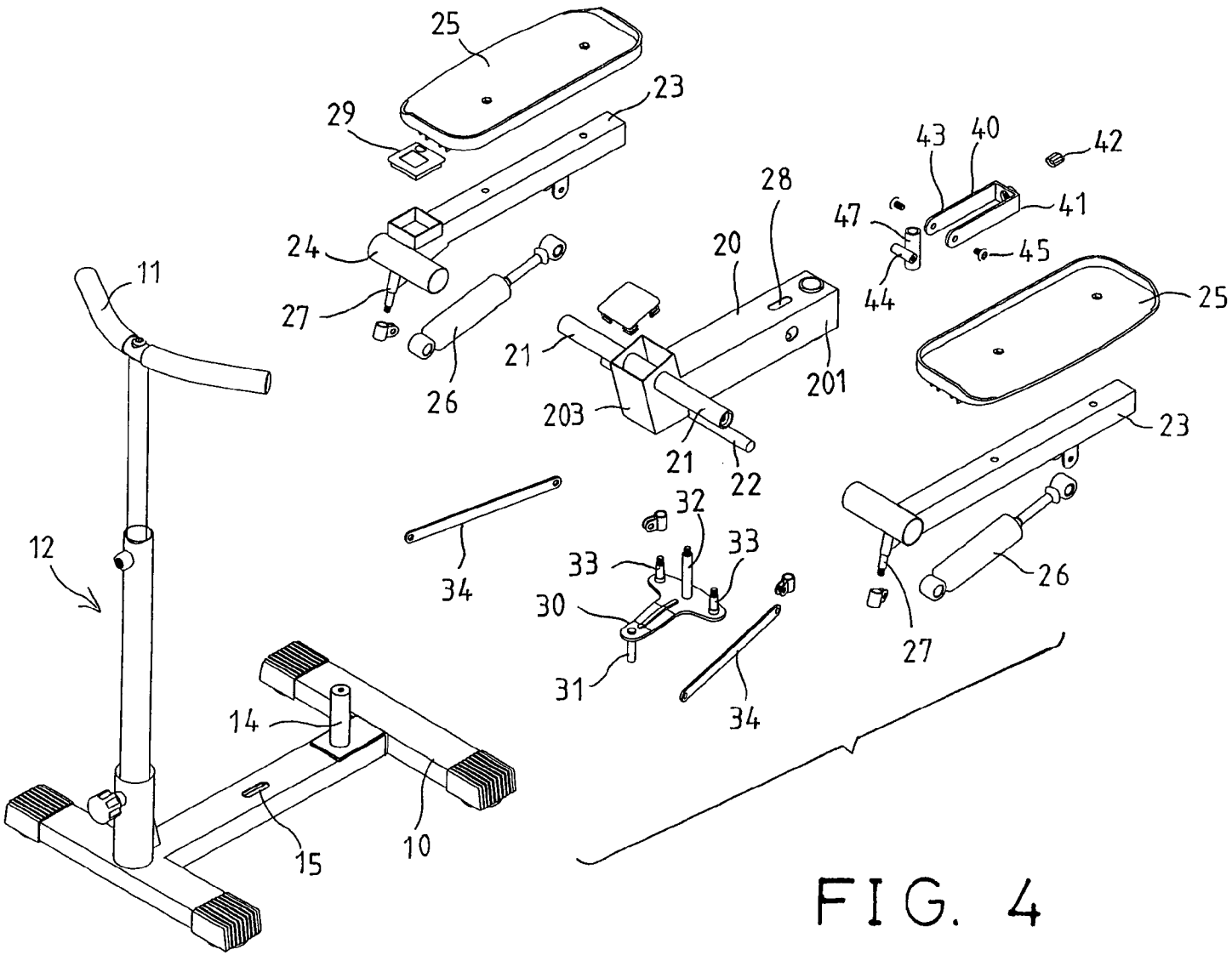
Figure 6:
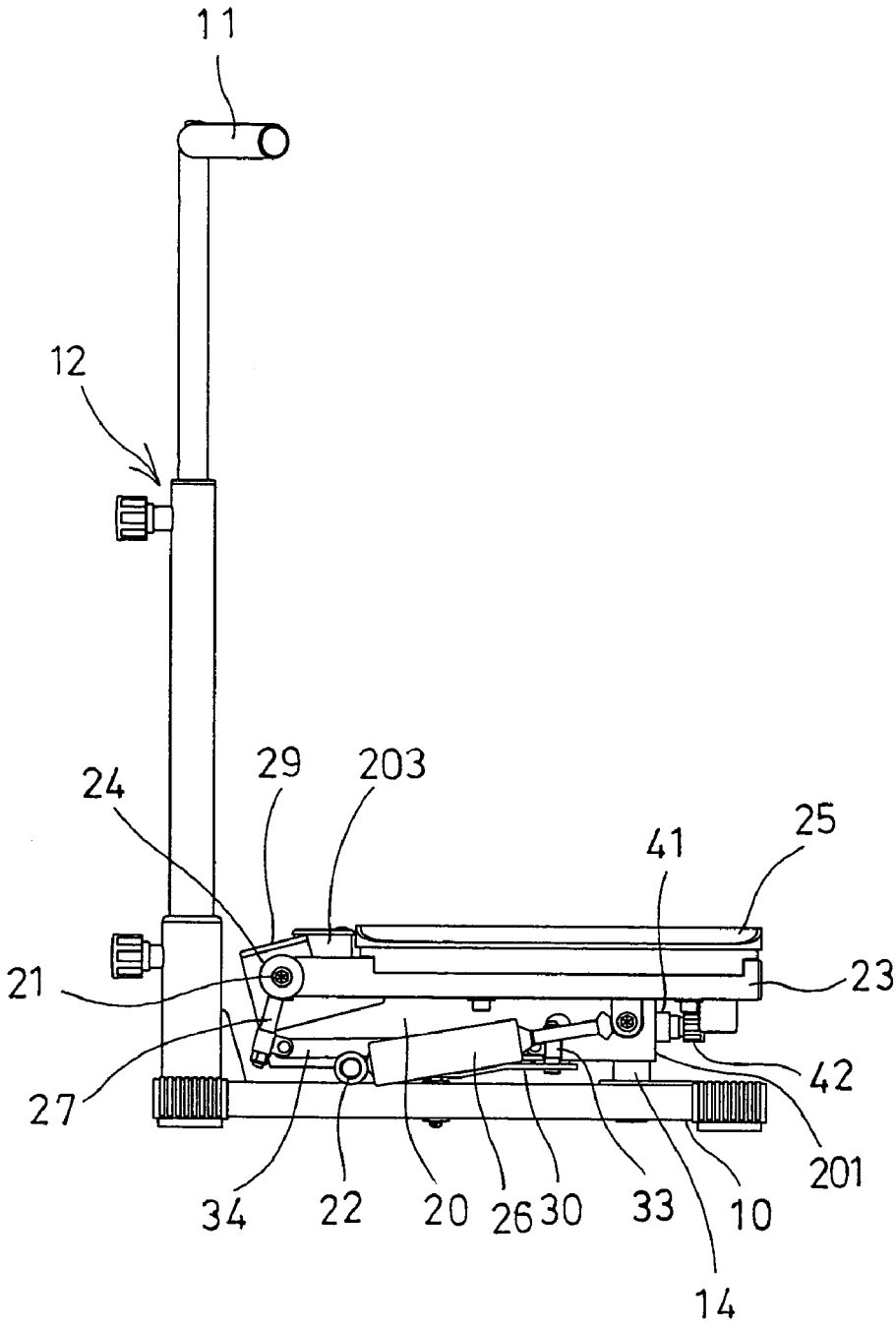
FIG. 6 is a side plan schematic view of the stepping exerciser.

Referring to the drawings, and initially to FIGS. 1–7, a stepping exerciser in accordance with the present invention comprises a base 10, a handle 11 optionally disposed on the front portion of the base 10 with a stem 12, such as an extendible or adjustable stem 12, to allow the handle 11 to be adjusted up and down relative to the base 10, according to different users' heights. The base 10 includes a shaft 14 extended upwardly from the rear portion thereof, and an oblong hole 15 formed in the middle portion thereof.

A longitudinal casing 20 includes a rear portion or first end rotatably or pivotally or swing ably secured on the base 10 with the shaft 14. The casing 20 includes a pole 21 and a rod 22 provided on the front portion or second end 203 thereof and preferably perpendicular to the casing 20. A pair of foot pedals 23 each includes a front portion 24 rotatably or pivotally secured to the pole 21 of the casing 20, and a pad 25 secured on top of the respective foot pedals 23 to support the users thereon. The pads 25 and the foot pedals 23 may also be formed integral with each other.

One or more cushioning devices 26 may further be provided to cushion the foot pedals 23 or the pads 25. For example, each of the cushioning devices 26 may include one or more spring members (not shown) or actuators 26, such as hydraulic or pneumatic cylinders 26, coupled between the foot pedals 23 or the pads 25 and the casing 20, such as the rod 22 of the casing 20, to apply resistive forces against the foot pedals 23 or the pads 25.

The foot pedals 23 and/or the pads 25 are thus rotatably or pivotally secured to the casing 20, and the casing 20 is swing ably or pivotally secured to the base 10 with the shaft 14, such that the foot pedals 23 and/or the pads 25 may be rotated relative to the base 10 in addition to the stepping exercises or operations. Each of the foot pedals 23 and/or the pads 25 includes an extension or actuator 27 extended from the front portion 24 thereof.

The casing 20 includes an oblong hole or a channel 28 formed therein, such as formed in the rear portion thereof and located close to the shaft 14 with which the casing 20 is rotatably attached to the base 10. A counter 29 may further be provided and attached to one of the foot pedals 23 and/or the pads 25, to count the stepping or actuation times of the foot pedals 23 and/or the pads 25. The counter 29 may also be attached to top of the handle 11 or the like, not shown in the drawing figures.

A follower 30 includes a front portion rotatably or pivotally or swingably secured on the base 10 with an axle 31, or includes an axle 31 extended downwardly from the front portion thereof and rotatably and slidably secured in the oblong hole 15 of the base 10, to allow the follower 30 to be rotated and slid relative to the base 10. The follower 30 includes a pin 32 and two pegs 33 extended upwardly from the rear portion thereof. It is preferable that the pin 32 is disposed between the pegs 33 of the follower 30.

Two links 34 are coupled between the pegs 33 and the actuators 27 of the foot pedals 23, and may be moved forwardly and rearwardly by the actuators 27 of the foot pedals 23, to allow the foot pedals 23 to force or actuate the follower 30 to rotate or swing relative to the axle 31 of the follower 30 when the foot pedals 23 are forced or stepped or actuated upwardly and downwardly relative to the base 10 in a reciprocating action by such as the users.

Figure 7:
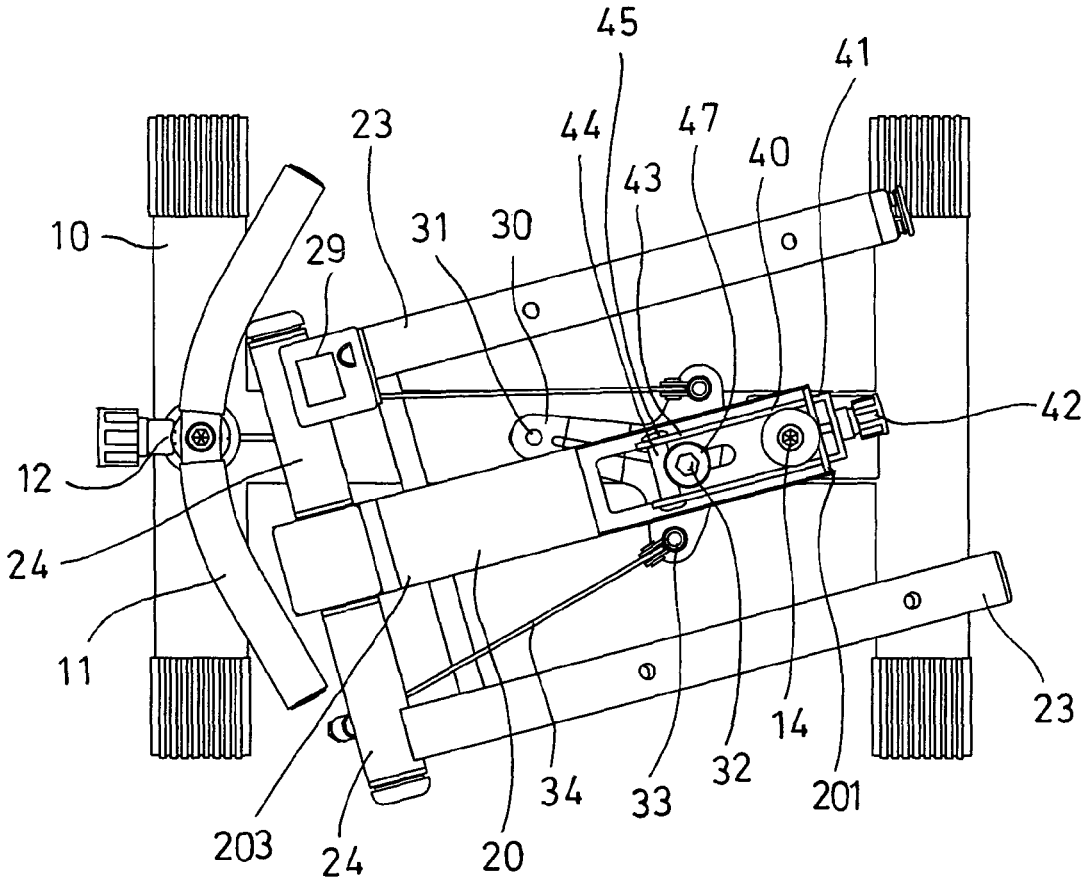
FIG. 7 is a top plan schematic view of the stepping exerciser.
Figure 8:
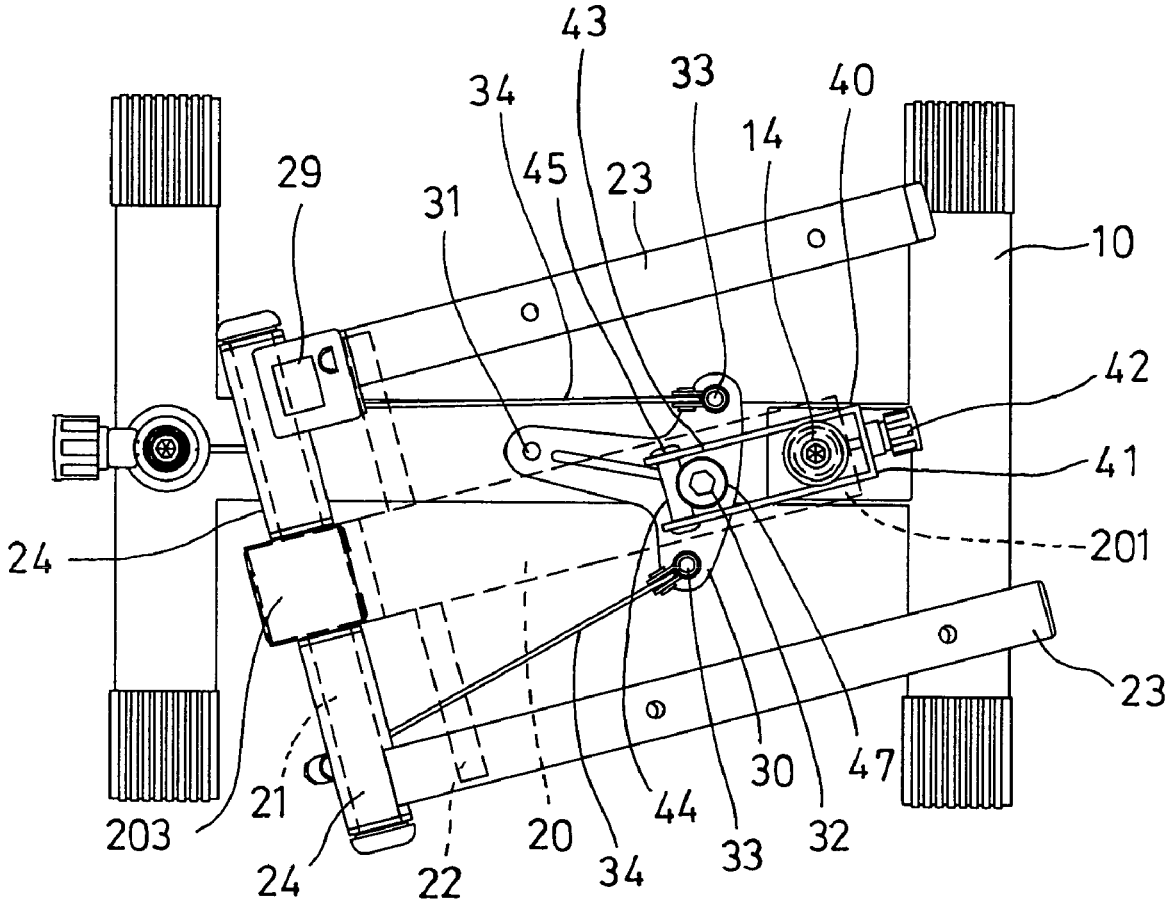
FIGS. 8, 9 are top plan schematic views similar to FIG. 7, illustrating the operation of the stepping exerciser.
Figure 9:
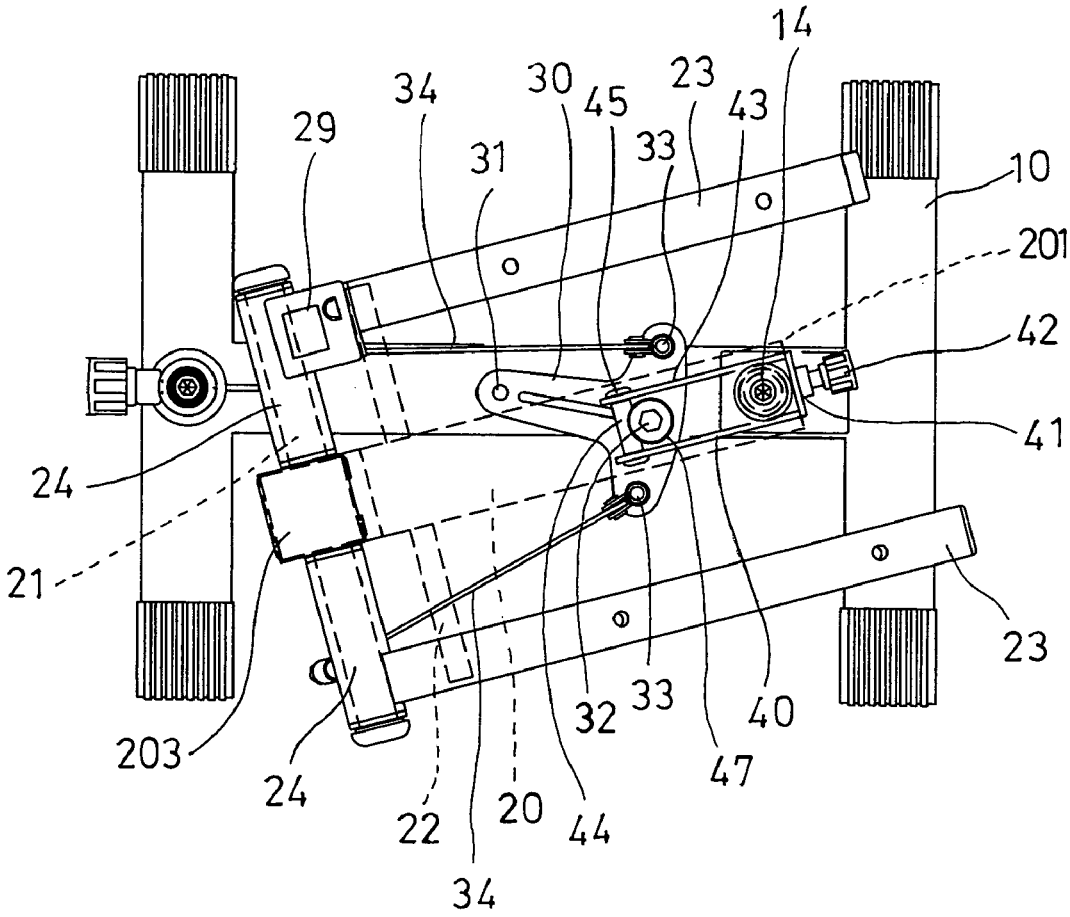

A frame 40 is slidably engaged in the rear portion of the casing 20, and includes one or first end 41, such as the rear end 41 extendible out of the casing 20 (FIGS. 2–3 and 7–9). An adjusting knob 42 is threaded through the rear end 41 of the frame 40 and engaged with the shaft 14 for moving or adjusting the frame 40 relative to the casing 20 when the adjusting knob 42 is rotated relative to the frame 40 and the casing 20, and thus for adjusting the rear end 41 of the frame 40 toward or away from the casing 20 or the shaft 14 (FIGS. 7–9).

The other end or second end or front portion 43 of the frame 40 is coupled to the pin 32 of the follower 30. For example, a stud 44 is secured to the front portion 43 of the frame 40 with one or more fasteners 45, and a barrel 47 is secured to the stud 44 and/or the front portion 43 of the frame 40 with fasteners (not shown) or by welding processes. The barrel 47 is rotatably engaged onto the pin 32 of the follower 30, such that the front portion 43 of the frame 40 may be pivotally coupled to the pin 32 of the follower 30.

In operation, when the foot pedals 23 and/or the pads 25 are stepped or actuated by the users, the foot pedals 23 and/or the pads 25 may be caused to rotate relative to the casing 20 about the pole 21, and the actuators 27 of the foot pedals 23 may thus be caused to move or to swing forwardly and rearwardly relative to the pole 21 and the casing 20, in order to force or actuate the follower 30 to rotate or swing relative to the base 10 about the axle 31 of the follower 30 by the links 34.

The pin 32 of the follower 30 is coupled to the casing 20, and is coupled to the front portion 43 of the frame 40 with the barrel 47, such that, at this moment, the frame 40 and the casing 20 may also be forced or actuated to rotate or swing relative to the base 10 by the pin 32 of the follower 30. The foot pedals 23 and/or the pads 25 may thus also be caused to rotate or swing relative to the shaft 14 of the base 10 together with the casing 20, in addition to the stepping operation of the foot pedals 23 and/or the pads 25.

The sliding engagement of the axle 31 of the follower 30 in the oblong hole 15 of the base 10 allows the follower 30 to slightly slide forwardly and rearwardly relative to the base 10. The sliding engagement of the pin 32 of the follower 30 in the channel 28 of the casing 20 allows the follower 30 and the frame 40 to be slightly slid or adjusted forwardly and rearwardly relative to the casing 20.

It is to be noted that the middle portion of the casing 20 is caused to rotate or swing relative to the base 10 by the pin 32 of the follower 30, and the casing 20 will not apply great forces against the pin 32 of the follower 30, such that the pin 32 of the follower 30 will not be damaged by the casing 20. The pin 32 of the follower 30 may thus be formed as an actuating device or means to easily engage and force the middle portion of the casing 20 and to force the casing 20 to rotate or swing relative to the base 10.

None of the prior stepping exercisers include a casing 20 having a middle portion to be forced to rotate or swing the casing 20 relative to the base 10.

The sliding engagement of the pin 32 of the follower 30 in the channel 28 of the casing 20 allows the follower 30 and the frame 40 to be slightly slid or adjusted forwardly and rearwardly relative to the casing 20 by the adjusting knob 42. When the follower 30 and the frame 40 are adjusted forwardly relative to the casing 20 and thus relative to the base 10, the links 34 may also be adjusted forwardly relative to the casing 20 and the base 10, such that the foot pedals 23 may be forced or adjusted downwardly relative to the base 10 by the actuators 27 of the foot pedals 23.

On the contrary, when the follower 30 and the frame 40 are adjusted rearwardly relative to the casing 20 and thus relative to the base 10, the links 34 may also be adjusted-rearwardly relative to the casing 20 and the base 10, such that the foot pedals 23 may be forced or adjusted upwardly relative to the base 10 by the actuators 27 of the foot pedals 23, and such that the moving stroke or status of the foot pedals 23 and/or the pads 25 may be adjusted relative to the base 10 by the adjusting knob 42.

Accordingly, the stepping exerciser includes a rotatable foot support or includes two rotatable foot pedals for allowing the users to swing their bodies in addition to the stepping exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stepping exerciser comprising:

a base, a casing including a first end rotatably attached to said base with a shaft, and including a second end and a middle portion, a pair of foot pedals having front portions rotatably attached to said second end of said casing, to allow said pair of foot pedals to be rotated upwardly and downwardly relative to said casing respectively, and means for actuating said middle portion of said casing to force said casing to rotate and swing relative to said base about said shaft;

said actuating means includes a pin engaged in said middle portion of said casing to force said casing to rotate and swing relative to said base;

said actuating means further includes a follower rotatably supported on said base and having said pin extended therefrom and engaged in said middle portion of said casing to swing said casing when said follower is rotated relative to said base.

2. The stepping exerciser as claimed in claim 1, wherein said follower includes an axle extended therefrom and rotatably secured to said base, to rotatably secure said follower to said base.

3. The stepping exerciser as claimed in claim 2, wherein said base includes an oblong hole formed therein to slidably receive said axle of said follower.

4. The stepping exerciser as claimed in claim 1, wherein said actuating means includes a pair of links coupled between said follower and said pair of foot pedals to allow said foot pedals to rotate said follower relative to said base.

5. The stepping exerciser as claimed in claim 4, wherein each of said foot pedals includes an actuator extended therefrom and coupled to said links respectively, to couple said foot pedals to said follower.

6. The stepping exerciser as claimed in claim 4, wherein said follower includes a pair of pegs extended therefrom and coupled to said links respectively, to couple said links to said follower.

7. The stepping exerciser as claimed in claim 1, wherein said middle portion of said casing includes a channel formed therein to slidably receive said pin, and to allow said pin to be adjusted relative to said casing.

8. The stepping exerciser as claimed in claim 1 further comprising means for adjusting said pin relative to said casing.

9. The stepping exerciser as claimed in claim 8, wherein said adjusting means includes a frame slidably received in said casing and coupled to said pin, to adjust said pin relative to said casing when said frame is moved relative to said casing.

10. The stepping exerciser as claimed in claim 9, wherein said frame includes a first end coupled to said pin and a second end extended out of said casing, and an adjusting knob threaded through said second end of said frame and engaged with said shaft to move and adjust said frame relative to said casing when said adjusting knob is rotated relative to said frame and said casing.

11. The stepping exerciser as claimed in claim 10, wherein said first end of said frame includes a barrel attached thereto and rotatably engaged onto said pin.

12. The stepping exerciser as claimed in claim 11, wherein said first end of said frame includes a stud attached thereto and secured to said barrel.

13. The stepping exerciser as claimed in claim 1 further comprising means for applying resistive forces against said foot pedals.

* * * * *